United States Patent [19]

Danforth et al.

[11] Patent Number: 4,691,500

[45] Date of Patent: Sep. 8, 1987

[54] LID SEALING MACHINE

[75] Inventors: Ronald V. Danforth, West Springfield, Mass.; Medric H. Pleau, Vernon, Conn.

[73] Assignee: Packaging Systems International, Inc., Ellington, Conn.

[21] Appl. No.: 888,111

[22] Filed: Jul. 18, 1986

[51] Int. Cl.[4] ..... B65B 7/28; B65B 51/14

[52] U.S. Cl. ..... 53/478; 53/485; 53/300; 53/307; 53/329; 53/373; 198/467.1; 156/69

[58] Field of Search ..... 53/300, 307, 373, 478, 53/485, 276, 281, 282, 329; 198/467.1; 156/69

[56] References Cited

U.S. PATENT DOCUMENTS

| | | | |
|---|---|---|---|
| 1,667,991 | 5/1928 | Russell | 198/467.1 X |
| 2,010,196 | 8/1935 | Muller . | |
| 2,011,829 | 8/1935 | Schnur . | |
| 2,645,399 | 7/1953 | Bozek et al. | 198/467.1 X |
| 2,972,216 | 2/1961 | Schmidt | 53/307 X |
| 3,064,407 | 11/1962 | Logemann et al. | 53/307 |
| 3,200,562 | 8/1965 | Zebarth et al. . | |
| 3,338,027 | 8/1967 | Amberg et al. . | |
| 3,418,785 | 12/1968 | Duryee | 53/373 X |
| 3,436,894 | 4/1969 | Sorensen . | |
| 3,452,513 | 7/1969 | Owens, Jr. | 53/373 X |
| 3,471,992 | 10/1969 | Amberg et al. . | |
| 3,511,025 | 5/1970 | Newport | 53/307 |
| 3,527,020 | 9/1970 | Mancini | 53/300 X |
| 3,572,004 | 3/1971 | Carmichael . | |
| 3,577,866 | 1/1971 | Ehrenfried . | |
| 3,710,937 | 1/1973 | Cook . | |
| 3,714,758 | 2/1973 | Vogeleer | 53/373 X |
| 3,886,708 | 6/1975 | Guse | 53/373 X |
| 3,938,305 | 2/1976 | Jansen et al. | 53/300 |
| 4,002,005 | 1/1977 | Mueller et al. . | |

*Primary Examiner*—Horace M. Culver

[57] ABSTRACT

A lid-sealing machine has an infeed system that employs a timing screw arranged to convey flanged trays along the upper portion thereof. The carousel on which the trays are supported during sealing has a multiplicity of locations, each with an associated heat and pressure applying platen; operation is continuous and with no indexing of the table.

28 Claims, 12 Drawing Figures

LID SEALING MACHINE

BACKGROUND OF THE INVENTION

Frozen foods and the like are commonly packaged in cartons, trays and other container for the product, closed by a lid sealed thereto. The trays and lids are typically made of paperboard, plastic or metal foil, or of laminates comprised of combinations of such materials, and heat sealable coatings, normally of a synthetic thermoplastic resinous material, may be applied thereto if the components are not inherently sealable. Generally, the trays will have a peripheral flange portion extending laterally outwardly about their openings, against which the covering lid is secured.

The lids are generally applied and sealed automatically on high speed machines, which must therefore be capable of receiving, closing and discharging the containers, rapidly, reliably and without damage to the package. The presence of lateral flange portions on the tray introduces difficulties of machine design, not only from the standpoint of conveyance through the machine but also with regard to the ability to achieve a good seal completely about the package.

It is conventional to use a microwave technique for activation of the sealable material, and chambers are normally provided for that purpose along opposite sides of a travel path for the lidded container. This means, however, that a rectangular package must be rotated 90° in order to seal all four edges, and it virtually precludes operation with containers that are not rectangular or that have flanges with curved sections.

As evidenced by the patents listed below, it is common to employ laterally disposed timing screws in packaging machinery for gating purposes. Flange portions of trays are not, however, suitable as the means by which they are engaged for movement through a machine, and consequently lateral flanges interfere with such operation involving a timing screw that is disposed alongside the travel path; moreover, such an arrangement is problematic when the containers are other than rectangular. The following U.S. patents typify the prior art in the field:

| U.S. Pat. No. | Patentee |
|---|---|
| 1,667,991 | Russell |
| 2,010,196 | Moller |
| 2,011,829 | Schnur |
| 2,645,399 | Bozek et al |
| 3,200,562 | Zebarth et al |
| 3,338,027 | Amberg et al |
| 3,418,785 | Duryee |
| 3,436,894 | Sorensen |
| 3,471,992 | Amberg et al |
| 3,572,004 | Carmichael |
| 3,577,866 | Ehrenfried |
| 3,710,937 | Cook |
| 3,938,305 | Jansen et al |
| 4,002,005 | Mueller et al |

Thus, the art does not provide a lid-sealing machine or method that is optimally suited for handling trays and other containers of various configurations, having laterally outwardly extending peripheral flange portions, and it is a primary object of the present invention to satisfy such a need.

It is a more specific object of the invention to provide a novel lid-sealing machine and method for securing lids to flange portions of containers that are non-rectangular or that have curved sections thereon, wherein the seal produced extends along the entire flange and has a high level of integrity.

Another object is to provide such a machine and method wherein the system for gating the containers is adapted to convey them reliably and efficiently, regardless of their shape and of the presence of a peripheral flange portion thereon.

A further object of the invention is to provide a high-speed machine that operates continuously, reliably, effectively and efficiently to achieve optimal output rates of lid-sealed containers.

SUMMARY OF THE INVENTION

It has now been found that certain of the foregoing and related objects of the invention are attained by the provision of a novel machine for sealing lids to containers under pressure. The containers have a body with upstanding sidewall portions and a flange portion extending laterally outwardly from about their periphery, and they will normally be of tray-like form and made of paperboard, metal foil, plastic, or the like.

The machine comprises a carousel including a revolving horizontal table with means at each of a multiplicity of circumferentially spaced locations for seating such a container or tray and for providing underlying support for its flange portion. The table also has a mechanism thereon at each of the locations for sealing a lid upon a container, under pressure and in cooperation with the seating means, as the table revolves.

An infeed system is provided for delivering the containers sequentially to each of the locations, and it includes a substantially horizontally disposed timing screw or timing screws, dimensioned and configured to engage the container body within the convolutions of its thread for conveyance therealong from its intake to its outlet end. A guide rail is disposed laterally adjacent and upwardly of the screw, and it extends generally parallel to the axis thereof for abutment by the containers as they are conveyed therealong. Means adjacent the intake end of the timing screw supports the containers in a horizontal attitude, and sequentially presents them to the upper portion of the screw.

In preferred embodiments, conveying means will be provided for carrying the trays from the outlet end of the timing screw, which may comprise a lug conveyor disposed along one side of the travel path, or above it. The guide rail will desirably be configured to provide both lateral and also horizontal support to the containers passing therealong, and a second similar guide rail, parallel to the first, may be provided along the opposite side of the travel path to cooperate therewith and with the lug conveyor.

The seating means will normally comprise a plate that is disengageably affixed to the table at each of the locations, the plate having one or more apertures configured to seat one of the containers with the flange portion thereof resting upon its marginal portion. It will also preferably include an elevator mechanism for raising and lowering an associated platform, as the table rotates, between a position substantially flush with the top of the table, to receive a tray, to a position downwardly therefrom to enable it to seat within the tool plate aperture; the platform may thereafter be elevated to facilitate removal of the lidded containers.

Normally, the sealing mechanism at each table location will comprise an electrically heated sealing head mounted for movement between a closed position directly over the seating means and an open position displaced therefrom. Most desirably, the head will be pivotably mounted by a toggle clamp arrangement, and a pneumatic piston will be used for effecting such movement. The piston actuating means will constantly maintain the sealing head in the closed position during a portion of each revolution of the table, and it will then maintain the head in the open position during the remainder of the cycle. Typically, the closed position will be maintained for approximately half a revolution. The machine may additionally include an outfeed system and a lid feeding and positioning system, and the transmission means will transmit power from the motor to the table and the timing screw (as well as any auxiliary systems) continuously and in ratios that are appropriate for rotating them in properly timed relationships.

Other objects of the invention are achieved by the provision of a novel method for sealing lids to containers of the type hereinabove described. The method involves the provision of a succession of containers to the upper portion of a horizontal timing screw, and delivering them therefrom to each of several locations on a continuously revolving carousel table, in properly timed relation to its movement. A lid is supplied to each container, after it is seated in a pocket of the table, and sealing conditions are constantly maintained during a portion of each revolution of the carousel.

DETAILED DESCRIPTION OF THE ILLUSTRATED EMBODIMENTS

Figure 1:
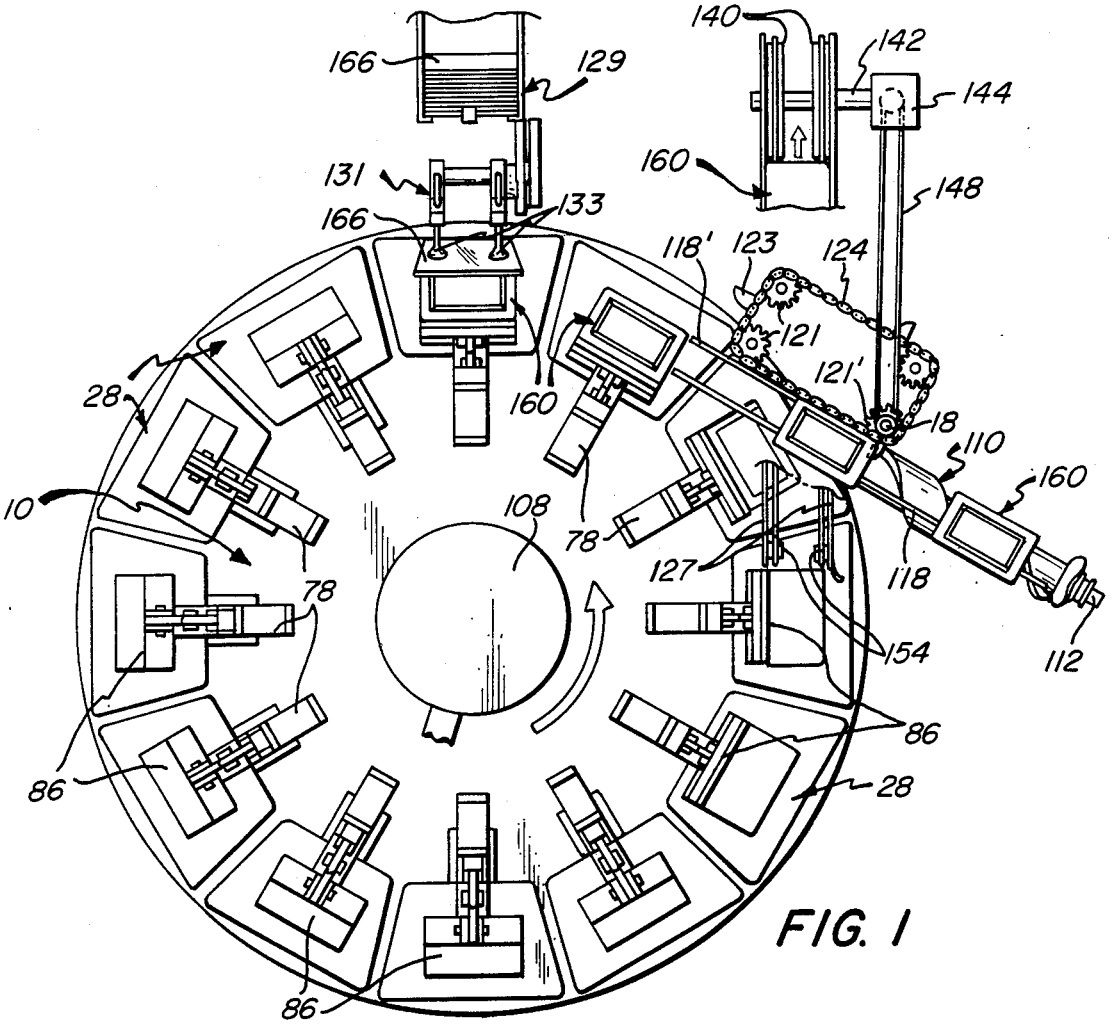
FIG. 1 is a fragmentary plan view, in partial section, showing a machine embodying the present invention.
Figure 2:
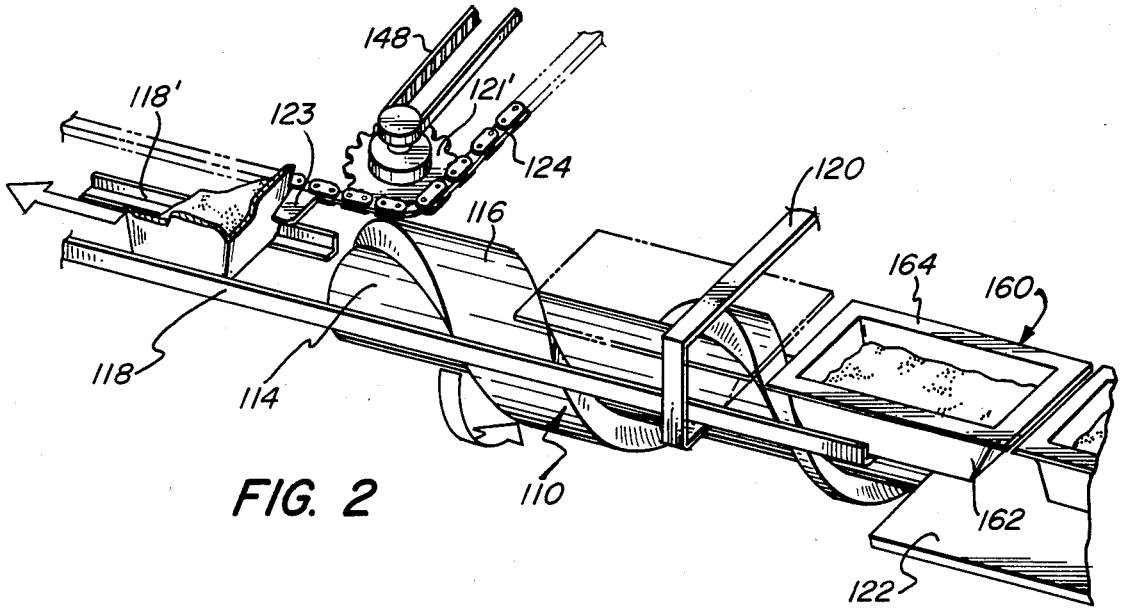
FIG. 2 is a fragmentary perspective view showing components of the infeed system for the machine, with entering trays depicted in full and phantom line, the scale of the Figure being greatly enlarged from that of FIG. 1.

Turning now in detail to FIGS. 1–9 of the appended drawings, therein illustrated is a lid sealing machine embodying the present invention, including a carousel consisting of a horizontal table, generally designated by the numeral 10, having a shaft 12 mounted (by means not shown) upon a base 14. Underlying support for the table 10 is provided by a number of wheels 15 rotatably mounted upon the upper ends of L-shaped brackets 17 (only one of which assemblies is shown) spaced equidistantly thereabout. A motor 16 is mounted by appropriate means (not illustrated) beneath the table 10, and it is connected to rotate the shaft 12 and table 10 in a counterclockwise direction (as shown by the arrows in FIGS. 1 and 9) through a belt 20 and a pair of pulleys 18.

Figure 4:
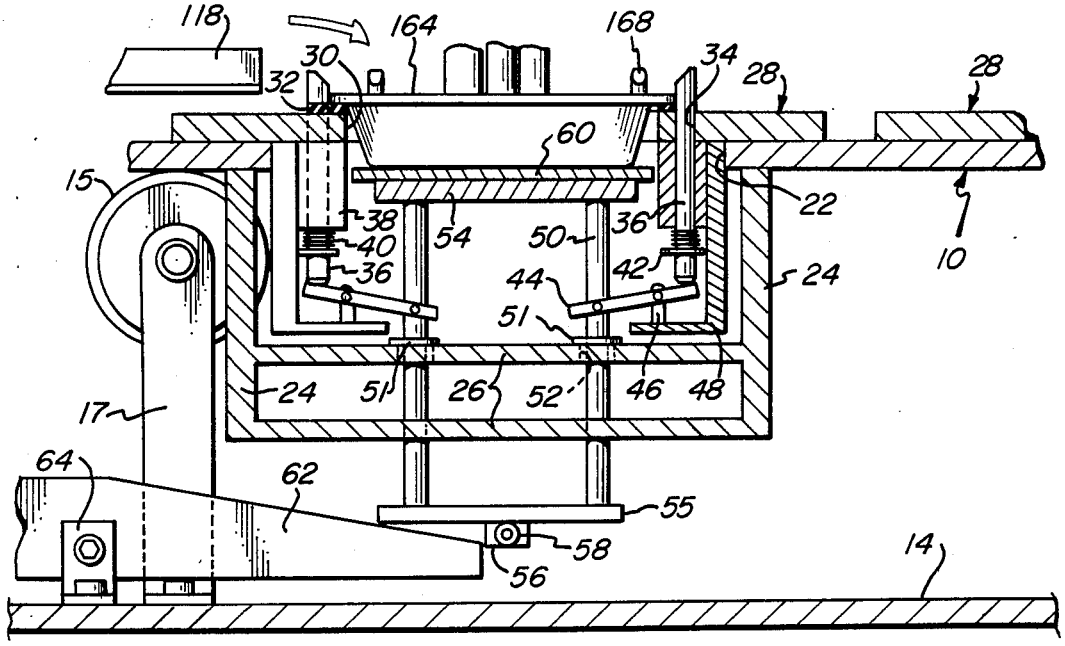
FIG. 4 is a vertical sectional view taken along line 4—4 of 3.
Figure 5:
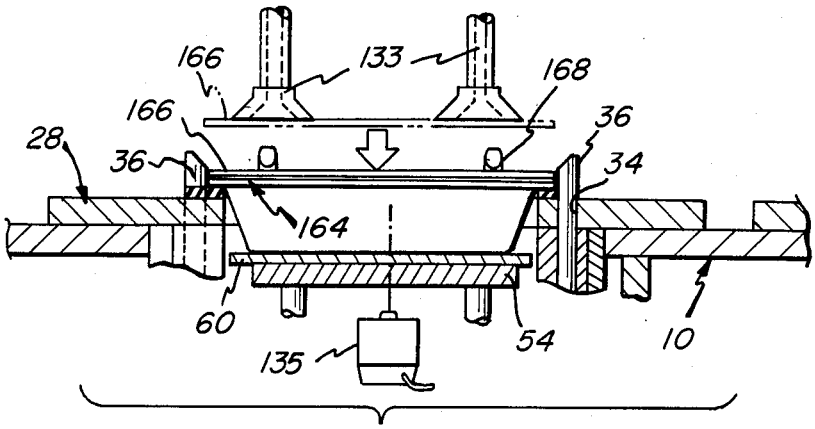
FIG. 5 is a fragmentary vertical sectional view of the carousel table and associated parts, taken at the lid-feeding station of the machine.
Figure 6:
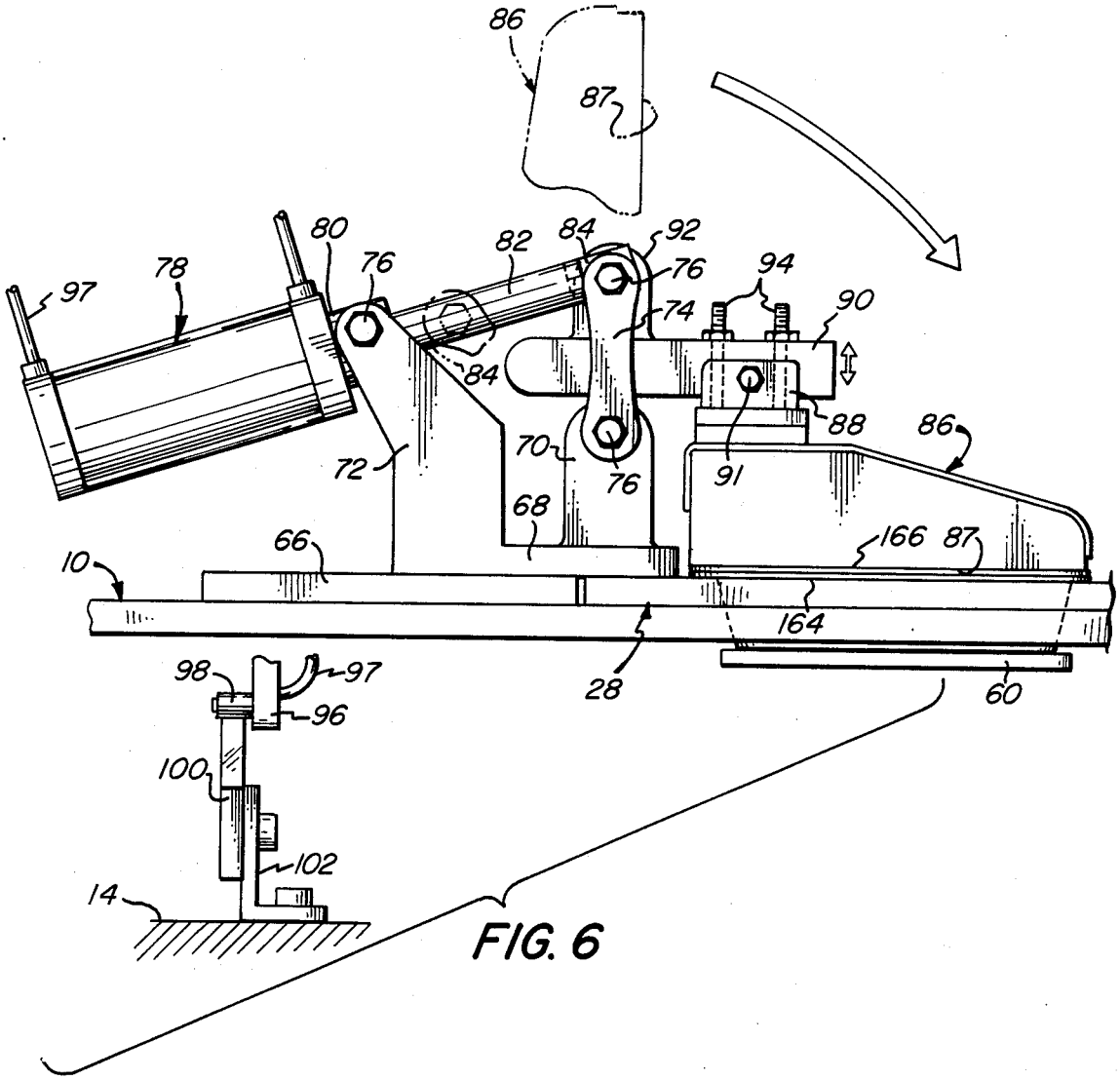
FIG. 6 is a side elevational view of a sealing location on the carousel, showing the sealing head assembly in closed (full line) and open (phantom line) positions, and also showing pneumatic system control means disposed beneath the carousel table.
Figure 7:
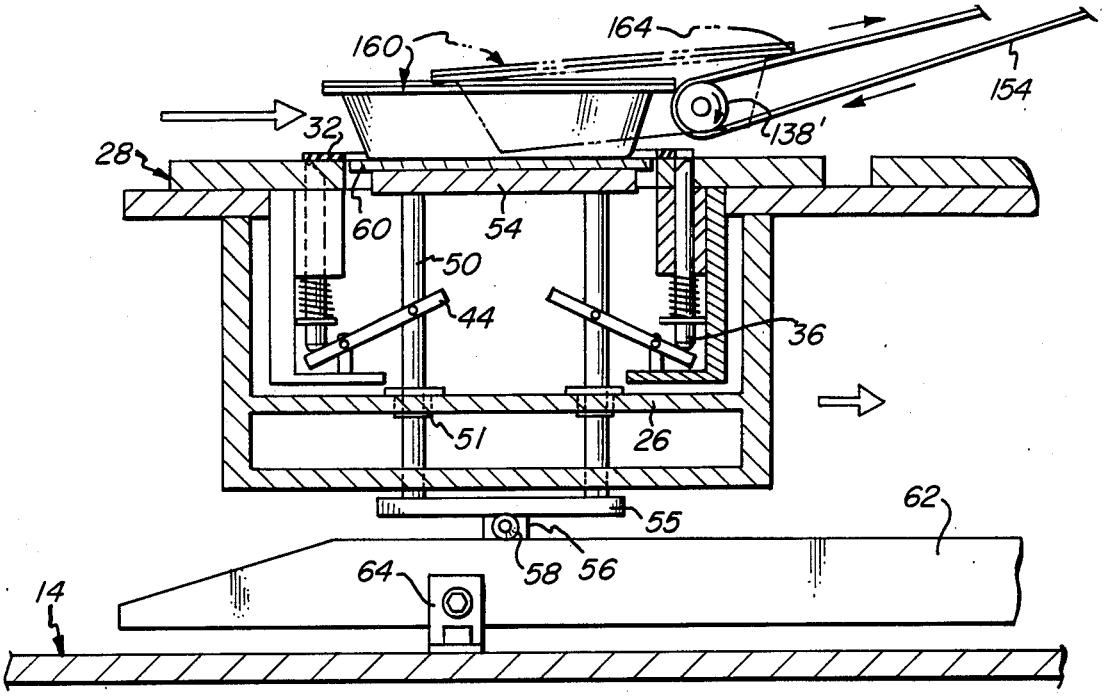
FIG. 7 is a sectional view of the machine taken at the outfeed station, showing in full and phantom line stages of container exit from the table.

The table 10 has, at locations spaced equidistantly about its circumference, twelve sealing head assemblies, each associated with an opening 22 formed through the table 10. As best seen in FIG. 4, an elevator mechanism-supporting frame is disposed beneath each opening 22, and consists of a pair of horizontally spaced vertical pieces 24 connected at their lower ends by a pair of vertically spaced cross pieces 26.

Also associated with each opening 22 is a tool plate, generally designated by the numeral 28, secured against the table top fasteners 29; the plates 28 are of frame-like construction, and each defines a central aperture 30. A gasket 32 (typically made of a heat-resistant silicone rubber) is supported upon the upper surface of each plate 28 and surrounds its aperture 30, and small circular front and rear holes 34 are formed therethrough to slideably receive retractable locating pins 36, which have inwardly-directed bevelled upper edges 37. The pins 36 pass through supporting blocks 38, and are biased downwardly by coil springs 40, which bear at one end upon the lower surface of the associated block 38 and, at the other end, upon the annular collar 42 of the pin.

A lever 44 is pivotably mounted upon a post 46 which projects upwardly from a shelf 48 adjacent each retractable pin, and has its outer end in contact with the tip thereof. Each lever 44 is pivotably connected, near its opposite end, to a vertical push rod 50, the latter being slideably mounted in a bushing 51 which is seated in an appropriately located aperture 52 formed through the upper cross piece 26; apertures for the rods are also provided in the lower cross piece. The two parallel push rods 50 are secured at their opposite ends to upper and lower plates 54, 55, respectively, and the lower plate 55 has a depending flange 56 thereon, which mounts a cam follower wheel 58; the wheel 58 cooperates (in a manner hereinafter to be described) with an elongated, arcuate cam rail 62, which is fixedly mounted upon the base 14 by appropriate brackets 64. A horizontal platform 60 is mounted upon the upper plate 54.

Figure 3:
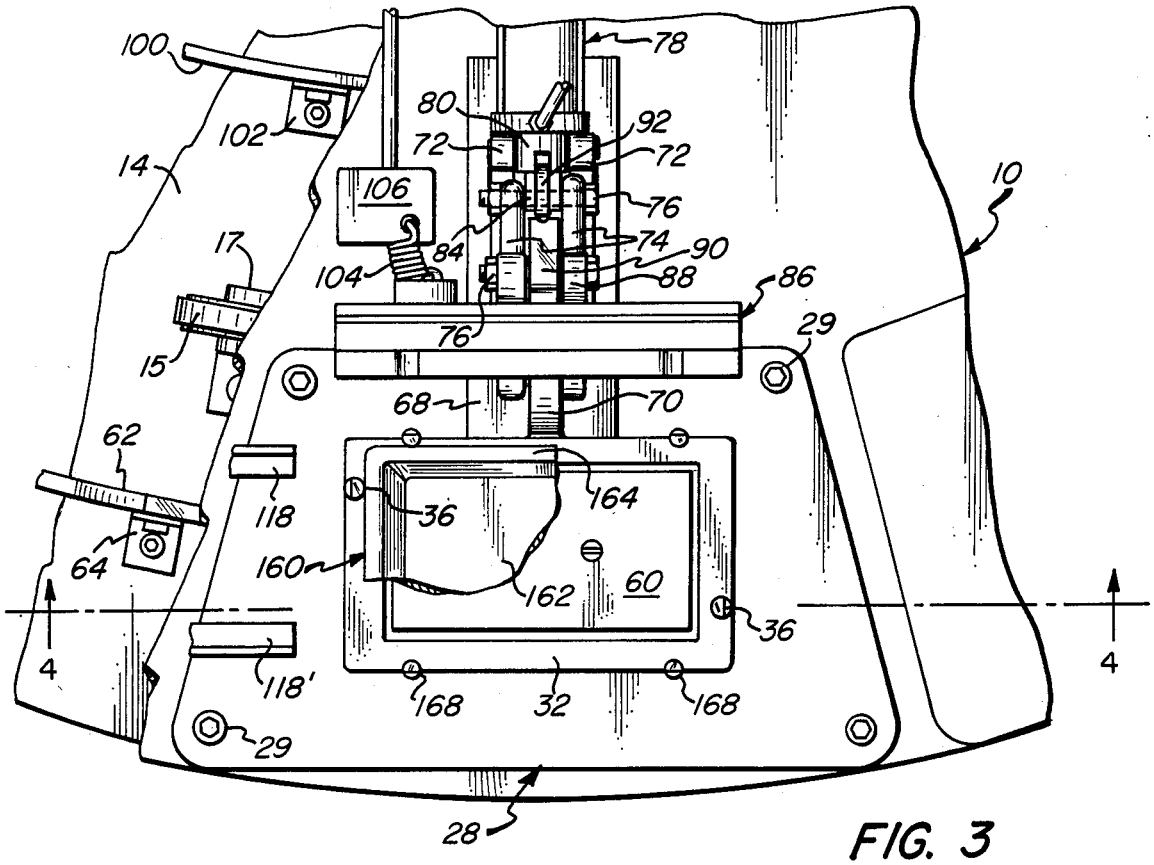
FIG. 3 is a fragmentary plan view showing one of the heat sealing locations of the carousel and other components of the machine mounted on the base below the revolving table thereof, drawn to a scale further enlarged from that of FIG. 2 and fragmentarily illustrating a tray seated within the cavity provided.

Each of the sealing mechanisms includes a mounting bracket, which is supported upon a mounting plate 66 disposed on the upper surface of the table 10 adjacent the corresponding tool plate 28. The brackets comprise a base 68, from which projects an upstanding fulcrum piece 70 and a pair of parallel angle arms 72, spaced radially inwardly therefrom. Two links 74 are pivotably mounted by a nut-and-bolt fastener set 76 on the opposite sides and at the upper end of the fulcrum piece 70, and a pneumatic cylinder 78 is affixed by similar means between the upper ends of the parallel arms 72, a forward part 80 of the cylinder 78 being adapted to that purpose. A piston rod 82, operatively connected to the pneumatic cylinder 78, has an outer end portion 84 of yoke-like construction, as best seen in FIG. 3.

The head assembly at each sealing location of the carousel table is comprised of a sealing head or platen, generally designated by the numeral 86, having a flat face 87 which will generally be coated with a low-friction, heat-resistant material, such as Teflon. Strip heaters or comparable elements (not illustrated) are incorporated into each of the sealing heads 86, and a thermostatic control feature will normally be provided as well; current for the heating elements is provided through an electrical wire 104, which is in turn connected to a power supply (not shown) through a junction box 106.

A bracket 88 is affixed to the top of the sealing head housing, and has engaged between the lateral elements thereof (see FIG. 3) an elongated support bar 90, the bracket 88 being affixed thereto by a nut-and-bolt fastener set 91. A lug 92 projects upwardly from the top of the bar 90, and it is in turn received between the elements of the yoke portion 84 at the end of the piston rod 82, being pivotably secured thereto and to the links 74 by a transversely extending fastener set 76. Balance, as well as variation of the amount of pressure exerted by the sealing head 86, can be achieved by use of the two adjustment screws 94 which pass through the bar 90 and into operative engagement with the head 86.

Operation of each sealing head assemblies is independently controlled by a pneumatic switch 96, which is mounted beneath the table 10 (by means not shown). It is connected to the associated cylinder 78 through a pneumatic line 97, and is actuated by the follower roller 98 that extends laterally from one side. The roller 98 is positioned to contact the stationary arcuate cam rail 100, supported upon the base 14 by suitable brackets 102, as the table 10 revolves. Suitable housing structure 108 is provided above the table 10 for the containment of utilities supply lines.

The infeed system for the machine consists of a horizontal timing screw, generally designated by the numeral 110, having an axial shaft portion 112 which is rotatably mounted on structure not shown. The screw 110 is advantageously made of a snythetic resinous material, and is comprised of a cylindrical core or root portion 114 and a thread element 116 extending thereabout, the element 116 being narrow at its intake end and progressively increasing in width to its outlet end to provide the desired timing effect. A right-angle rail 118' is supported by a frame piece 120 to extend parallel to the axis of the timing screw 110, along one side and upwardly thereof; the inwardly directed bottom flange of the rail 118 lies substantially in a horizontal plane with the uppermost surface of the screw core 114. A second length of right-angle rail 118' extends from a point adjacent the outlet end of the screw 110 and to the side thereof opposite to that along which the rail 118 extends, and a horizontal counter 122 is disposed adjacent the inlet end of the screw.

A lug conveyor assembly is also positioned near the outlet end of the timing screw 110, and consists of an endless chain 124 mounted upon a set of four sprocket wheels 121, which are disposed laterally of the screw 110. The chain mounts three lugs 123, which project outwardly at equidistantly spaced locations to extend therefrom beyond the rail 118' and to run for a distance therealong.

Figure 9:
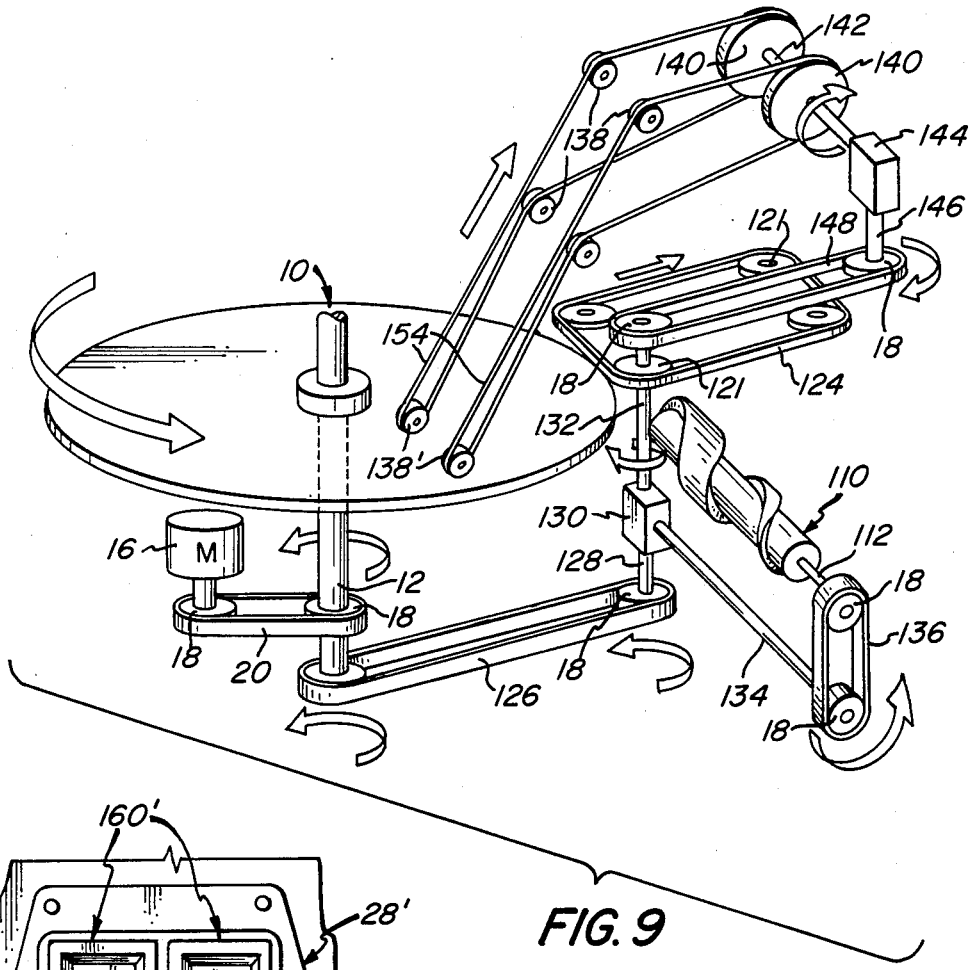
FIG. 9 is a schematic perspective view illustrating the drive and transmission arrangement for the several mechanisms and systems of the machine.

As best seen in FIG. 9, a pulley 18 is disposed on the lower end of the main drive shaft 12 for the table 10, and is connected to a like pulley 18 on the lower end of the parallel shaft 128, through a timing belt 126. The shaft 128 is in driving engagement with the shafts 132 and 134 through the transmission box 130, the gearing therewithin being such as to reverse the direction of rotation of shaft 132, with respect to that of shaft 128, as indicated by the arrows. One of the sprocket wheels 121' of the side lug conveyor assembly is mounted near the upper end of the shaft 132, and a pulley 18 is disposed thereabove. Shaft 134 also carries a pulley 18 at its outer end, and serves to drive the timing screw 110 through the belt 136 and the pulley 18 on the outer end of the screw shaft 112.

The system for feeding lids to the carousel location consists of a magazine generally designated by the numeral 129, for supporting a stack of lids, and a pivotable vacuum take-off and delivery assembly generally designated by the numeral 131, the latter including a cooperating pair of vacuum nozzles 133. The nozzles 133 are supported to pivot between a position adjacent the lower end of the magazine 129 and a position directly over the table 10. An optical sensing device 135 is located near the table, and is operatively connected to control the action of the vacuum take-off and delivery assembly.

Figure 8:
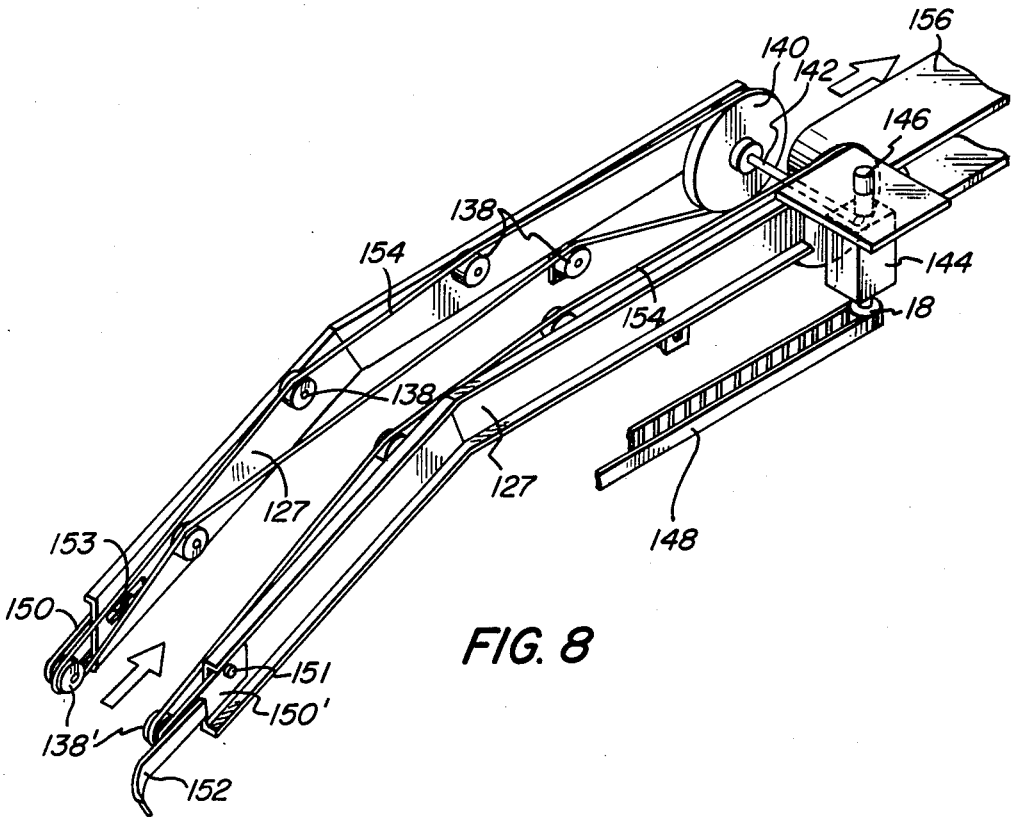
FIG. 8 is a fragmentary perspective view showing details of the outfeed system.

The outfeed system for the machine is most fully illustrated in FIG. 8, and consists of a ramp formed by a pair of angled side rails 127 mounted in parallel relationship with their lower, inner end portions extending over the table 10. Each rail 127 has a set of small idler rolls 138 rotatably mounted upon its inner surface, and two relatively large diameter drive wheels 140 are affixed to a common transverse shaft 142 at the upper, outer end of the ramp. The shaft 142 is operatively engaged, through a transmission box 144, to a drive shaft 146, which is driven by the shaft 132 through a timing belt 148 and pulley 18.

Supporting bars 150, 150' are secured to the lower ends of the side rails 127 by fasteners which are received within elongated slots 153 formed through the rails; this permits extension of the bars 150, 150' and thereby adjustment of the rollers 138' mounted thereon. The bar 150' carries a curved finger 152, which serves as a guide into the channel between the two rails. An endless carrier band 154, normally made of a high-friction rubbery material, is disposed on each rail about the associated wheel 140 and threaded through the idler rollers 138, 138', so as to provide an upper flight generally along the top edge of the rail; tension is adjusted by extension of the bars 150, 150'. An endless conveyor belt 156 is positioned adjacent the outer end of the outfeed ramp arrangement.

As embodied in FIGS. 1–9, the machine of the invention is most suitably adapted for placing and sealing lids upon trays of the configuration shown therein and generally designated by the numeral 160; such trays are typically employed for food products, which may be in frozen condition, although the machine can of course be used for packaging other products, such as confections, pharmaceuticals, hardware items, etc. The trays are suitably fabricated from paperboard, and have a substantially rectangular cross sectional configuration with a tapered sidewall body 162 and a peripheral flange 164 extending entirely thereabout in a laterally outward direction. The presence of such a flange effectively precludes use of a timing screw along the side of the carton travel path, because the flange is unsuited to serve as the means by which the cartons are engaged and moved through the gating system.

In operation, the cartons or trays 160 are moved, end-to-end, across the counter 122 to the inlet portion of the timing screw 110. They will normally be delivered to the counter by a conveyor, which will desirably run faster than the timing screw to provide a positive feed effect.

As the cartons are pushed forwardly over the timing screw, the end-most one will slide on its bottom wall along the top of the core portion 114 until the relatively narrow inlet end of the rotating thread element 116 enters behind it and in front of the next carton, thereby providing the desired gating function; the pitch and depth of the thread element 116 are dimensioned to accommodate the body of the tray within its convolution. The increasing width of the thread of course develops the carton-to-carton spacing necessary to present each of them at the proper time to one of the sealing locations of the revolving carousel table 10. The rotation of the screw forces the cartons against the guide rail 118, and they slide along it with their lower corners at one side supported laterally and from below, due to the right angular configuration of the rail. The lugs 123 on the chain conveyor are spaced to pick up each carton as it reaches the outlet portion of the timing screw, and to slide them further along the guide rails 118, 118'.

The carousel is timed to the infeed system to present one of its twelve cavities to receive each carton as it exits from the guide rails. The platform 60 of the elevator mechanism is substantially flush with the surface of the tool plate 28 at the time of initial carton contact, and it lowers as the carousel table 10 revolves, due to the downward slope of the end of the cam rail 62 on which the follower wheel 58 rides. Thus, as the table continues to rotate the carton is lowered into the tool plate aperture 30, allowing its flange portion 164 ultimately to come to rest upon the surrounding gasket 32. The retractable locating pins 36 are extended by operation of the push rods 50, acting through the levers 44, to ensure centralization of the carton and to provide means for guiding the covering lid into position thereupon, as will be described. Although desirable in some instance, it has been found that retractability of the pins 36 is often unnecessary.

The fully seated position of the carton, and the relationships of the various parts immediately following loading, are illustrated in FIGS. 3 and 4 of the drawings. They correspond to the one o'clock position of the carousel, as viewed in FIG. 1. The lid feeding system is located at the twelve o'clock position and is actuated when a carton is presented thereto by further rotation of the table 10, as confirmed by the optical sensor 135. The mechanism 131 pivots to cause the vacuum nozzles 133 to withdraw the lowermost lid 166 from the stack contained in the magazine 129, and then turns to position it directly over the carton. Upon release of the vacuum force the lid is deposited over the carton opening with its marginal portions in full surface contact with the peripheral flange 164.

At the eleven o'clock position, the follower roller 98 of the pneumatic switch 96 encounters the fixed cam rail 100, allowing pressurized air to flow into the cylinder 78 and thereby effect extension of the piston rod 82. This causes the sealing head 86, acting through the links 74 and the bar 90, to close tightly upon the lid, and to apply heat and pressure (typically 360° F. and 5,000 psig) thereto to activate the heat-sealable substance (e.g., a thermoplastic coating) on the lid and to effect the desired sealing action. The high pressure desired is readily achieved by virtue of the toggle clamp arrangement described, and its magnitude can be finely adjusted, as desired, by use of the screws 94.

These conditions are maintained, in the embodiment shown, from approximately the eleven o'clock to the four o'clock position of the carousel (i.e., through about 180° of table revolution), although takeoff could occur sooner so as to further increase the output rate of the machine. The machine typically handles 60 to 100 cartons per minute, providing a 2 to 6 second sealing time; pressure, dwell time, speed and temperature are all variable to optimize operation, through the incorporation of suitable electrical and pneumatic controls (not shown). It will be appreciated that the table revolves continuously, with no intermittent movement or indexing being necessary, thereby maximizing output rates.

When the carousel table reaches the four o'clock position, the rail 100 actuates the pneumatic switch 96 to open the sealing head 86. Further rotation presents the follower wheel 58 to the rail 62, causing the platform 60 to elevate and the retractable pins 36 to descend, each to a substantially flush position. Elevation of the platform serves to lift the carton 160 from the pocket in which it is seated to position it for exit from the carousel, and retraction of the forward pin ensures that it will not interfere. Take-off is accomplished by introducing the carton body between the lower ends of the angled side rails 127, causing the lateral elements of the flange portion 164 to engage the endless bands 154. The carton is carried by friction up the ramp provided by the rails, and is deposited upon the upper flight of the conveyor belt 156 for removal from the machine location.

Figure 10:
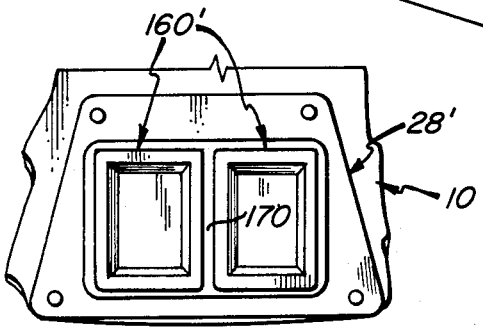
FIG. 10 is a fragmentary plan view showing a variation of the machine in which a double-cavity tool plate is installed within the carousel table.

FIG. 10 shows a second form of tool plate 28' suitable for use in the instant machine. It has a central bar 170 dividing it into two portions, thereby providing a double-cavity change part. As a result, two smaller cartons 160' can be sealed simultaneously at each table location. Any of various arrangements of multiple cavity tooling can of course be substituted.

Figure 11:
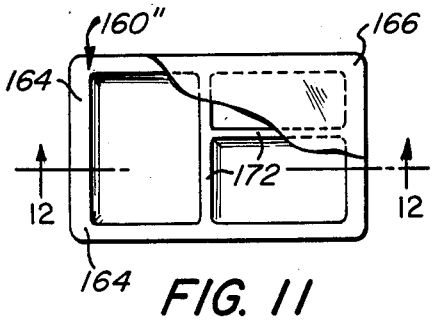
FIG. 11 is a plan view of an internally partitioned tray that is suitable for lid sealing using the present machine.
Figure 12:
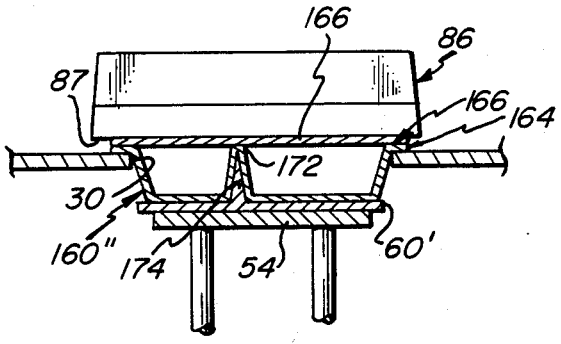
FIG. 12 is a sectional view, taken along line 12—12 of the tray of FIG. 11, showing a modification to the elevator assembly made to accommodate it.

An internally partitioned tray 160'' is illustrated in FIG. 11, and a modification of the platform 60', made to most desirably handle it, is shown in FIG. 12. The tray has hollow upstanding walls 172 dividing it into compartments, and the platform 60' has rib structure 174 thereon which enters between the wall elements. Consequently, when the lid 166 is secured sealing will be effected not only in the area of its flange portion 164 but also along the top edge of the partitioning walls 172.

As will be appreciated, the machine of the invention is ideally suited for securing lids to trays, cartons and other containers having peripheral flanges, and especially those that have flange portions including curved elements. The microwave activation of sealable coatings that has commonly been used in the past for such containers requires movement of the flange through lateral chambers (as discussed above), which requires reorientation of rectangular cartons to effect sealing along all four sides of its peripheral flange; moreover, such an arrangement virtually precludes use with containers having curved flanges, as a practical matter.

The location of the timing screw, so as to engage the body of the carton at the bottom rather than along its side, is an important feature of the present machine, and once again greatly facilitates use with cartons having lateral flanges. Finally, due to the design of the carousel and the sealing head mechanisms provided at its several locations, continuous rotation and constant application of heat and pressure are afforded for high output and most efficient sealing, and the toggle clamp mechanism employed generates optimal pressure conditions. As indicated above, various components of the machine may be in the form of change parts to expand its utility, suitable modifications of course also being made to the power transmission system to effect any changes in operation that may be necessary. Moreover, a pair of timing screws could be employed for double-lane feeding, the cooperating conveyor could be disposed above, rather than alongside, the travel path, the number of lugs on such a conveyor could vary, and other changes could be made, as will be evident to those skilled in the art.

Thus, it can be seen that the invention provides a novel lid-sealing machine and method for securing lids to flange portions of containers of various configurations, in which the seal produced extends along the entire flange and has a high level of integrity. The system employed for gating the containers is adapted to convey them reliably and efficiently, regardless of their shape and of the presence of the peripheral flange portion, and the machine provided operates continuously, reliably, effectively, efficiently and at high speeds to achieve optimal output rates of lid-sealed containers.

Having thus described the invention, what is claimed is:

1. In a machine for sealing lids to containers having a body with upstanding sidewall portions and a flange portion extending laterally outwardly about the upper periphery thereof, the combination comprising:

a carousel including a revolving horizontal table with means at each of a multiplicity of locations spaced circumferentially thereabout for seating such a container and for providing underlying support for its flange portion, said table also having at each of said seating locations a mechanism thereon for sealing a lid upon a container thereat, said sealing mechanism including a platen movable downwardly against said seating means for applying pressure in cooperation with said seating means and movable concurrently with said table as said table revolves along an arc aqual to at least one-fourth of the circle of rotation of said table; and an infeed system for delivering such containers sequentially to each of said locations as said table revolves, said system defining a rectilinear feed channel extending along a path substantially tangential to the circle of rotation of said seating means, said infeed system including at least one substantially horizontally disposed timing screw disposed at the base of said feed channel along a portion of the length thereof and dimensioned and configured to receive and engage the bottom portion of the body of such containers within the convolution of its thread portion for conveyance therealong from an intake end to an outlet end thereof to produce a predetermined spacing of the containers along said feed channel defined by said thread portion of said timing screw, a guide element having a surface portion disposed laterally adjacent and upwardly of said screw and extending generally parallel to the axis thereof for abutment by the containers conveyed thereby, and means adjacent said intake end of said timing screw for supporting the containers in a horizontal attitude and for sequentially presenting them to the upper portion of said screw.

2. The machine of claim 1 wherein the width of the thread element of said timing screw thread portion increases progressively from said intake end to said outlet end thereof, said thread portion being relatively narrow at said intake end to facilitate its entry between adjacent containers presented thereto.

3. The machine of claim 1 wherein said supporting means of said infeed system comprises a horizontal surface adapted to accommodate the flanges of a number of the containers in line for presentation to said timing screw.

4. The machine of claim 1 wherein said infeed system additionally includes along said path means for conveying the containers from said outlet end of said timing screw to said carousel table.

5. The machine of claim 4 wherein said conveying means comprises a lug conveyor disposed along said path of the containers which cooperates with said guide element portion extending therealong and spaced therefrom.

6. The machine of claim 5 wherein said guide element is a rail configured to provide both lateral and also horizontal support to the containers passing therealong, and wherein a second guide rail, parallel to said first-mentioned rail, is provided along said one side of said travel path to cooperate therewith and with said lug conveyor for so conveying the containers.

7. The machine of claim 1 wherein said seating means comprises a plate that is disengageably affixed to said table at each of said locations, said plate having at least one cavity dimensioned and configured to seat one of the containers with the flange portion thereof resting upon a marginal portion of said plate surrounding said cavity.

8. The machine of claim 7 wherein plate is divided into a plurality of sections, each of said sections defining a cavity dimensioned and configured to seat one of such containers with the flange portion thereof so disposed.

9. The machine of claim 1 additionally including an elevator mechanism disposed below said table at each of said locations thereon, said elevator mechanism including a platform and elevator means for raising and lowering said platform between a position substantially flush with the top of said table and a position downwardly therefrom, said elevator means being actuatable to raise said platform when the one of said locations with which it is associated is adjacent the outlet of said infeed system, and to lower said platform as said table rotates to move said one location therebeyond.

10. The machine of claim 9 wherein said elevator means comprises a stationary arcuate cam rail disposed beneath said table and a cam follower operatively attached to said platform and disposed for contact with said cam rail, said elevator mechanism including a frame on which said platform is disposed and mounted for vertical sliding movement under said table.

11. The machine of claim 9 additionally including a pair of guide pins at each of said locations, said pins being disposed adjacent the circumferentially opposite ends of said container seating means and being mounted for vertical movement between positions extended above the upper surface of said table and positions substantially flush therewith, said pins being operatively connected to said elevator mechanism to move upwardly when said platform is lowered, and vice versa.

12. The machine of claim 1 wherein said sealing mechanism at each of said table locations comprises an electrically heated sealing head mounted on said table for movement between a closed position directly over said seating means and an open position displaced therefrom.

13. The machine of claim 12 wherein said sealing head at each of said locations is pivotably mounted for such movement by a toggle clamp arrangement, and wherein said sealing mechanism includes a pneumatic piston for effecting such movement of said head, and means for actuating said piston to properly position said head with respect to said seating means in timed relationship to the revolution of said table.

14. The machine of claim 13 wherein said piston actuating means constantly maintains said sealing head in said closed position along said arc in each revolution of said table, and constantly maintains said head in said open position during the remainder thereof.

15. The machine of claim 14 wherein said arc during which said closed position is maintained is approximately half a revolution.

16. The machine of claim 13 wherein said toggle arrangement includes a bar on which said sealing head is mounted, said bar having means thereon for adjusting the position of said head relative thereto, to thereby permit adjustment of the amount of pressure exerted by said head in said closed position thereof.

17. The machine of claim 9 wherein said machine is adapted for sealing lids upon internally partitioned containers, and wherein said platform of said elevator mechanism has an upstanding rib thereon dimensioned, configured and positioned for insertion upwardly into the partitioning element of the container and to cooperate with said sealing mechanism to seal the lid to the upper edge of the partitioning element.

18. The machine of claim 1 additionally including an outfeed system for effecting the removal of lidded containers from said table as said table revolves, said system including a ramp having a portion disposed over said table to intercept said locations and having means thereon for carrying the containers away from said table.

19. The machine of claim 9 additionally including an outfeed system for effecting the removal of lidded containers from said table as said table revolves, said system including a ramp having a portion disposed over said table to intercept said locations and having means thereon for carrying the containers away from said table, said elevator mechanism being operative to lift the containers to a position in which the flange portions thereof are disposed above said table at a position approaching the inlet end of said ramp, said carrying means being adapted to engage under the flange portion of each container.

20. The machine of claim 18 wherein said carrying means comprises a pair of endless bands disposed on said ramp with a channel therebetween for passage of the body portions of the containers, each of said bands having an upper flight for contact under an opposite side element of the flange portion, and being made of a material adapted to frictionally engage the container flange portion.

21. The machine of claim 1 additionally including a lid feeding and positioning system.

22. The machine of claim 1 additionally including a motor and transmission means for transmitting power from said motor to said table and said timing screw in ratios appropriate for continuously rotating them in properly timed relationships.

23. In a method for sealing lids to containers having a body with upstanding sidewall portions and a flange portion extending laterally outwardly about the upper periphery thereof, the steps comprising:

operating a carousel including a revolving horizontal table with means at each of a multiplicity of locations spaced circumferentially thereabout for seating such a container and for providing underlying support for its flange portion, said table also having a mechanism thereon at each of said locations for sealing a lid upon a container thereat, under pressure in cooperation with said seating means and movable with said sealing means as said table revolves;

operating an infeed system to deliver containers sequentially to each of said locations as said table revolves, said system defining a rectilinear feed channel extending along a path substantially tangential to the circle of rotation of said seating means, said system including at least one substantially horizontally disposed timing screw disposed at the base of said feed channel along a portion of the length thereof, said screw rotating during said operation and being dimensioned and configured to receive and engage the bottom portion of the body of such containers within the convolution of its thread for conveyance therealong from an intake end to an outlet end thereof;

causing said table to continuously revolve;

causing said timing screw to continuously rotate in timed relation to said table;

continuously delivering to said feed channel and the upper portion of the intake end of said timing screw a succession of containers, arranged end-to-end, said containers entering individually with the bottom portions seating in the convolution of the thread of said rotating screw with the bottom surfaces thereof riding upon the core portion of said screw to produce a predetermined spacing of the containers along said feed channel defined by said thread portion of said timing screw, said timed relationship of revolution and rotation causing one of said table locations for seating said containers to be disposed adjacent the exit end of sAid infeed system to receive each container as it exits therefrom to seat containers in said seating locations as said table rotates;

supplying lids to said carousel as it rotates to locate a lid on said flange of each of said containers; and moving said sealing mechanism downwardly against said lid to effect sealing thereof to said flange, said sealing mechanism rotating with said table in said sealing position along an arc equal to at least one-fourth of the circle of rotation of said table to effect sealing thereof.

24. The method of claim 23 wherein said carousel table has a container-seating cavity at each of said locations and elevator means associated therewith having a platform, said method additionally including the steps of elevating said platform to receive one of said exiting containers and thereafter lowering said platform to seat said container within said cavity.

25. The method of claim 24 wherein lid feeding means is provided at a station adjacent said table and supplies said lids to each of said seated containers as said table rotates past said station; and including the additional steps of withdrawing said sealing means; and effecting the removal of the lidded containers from said table.

26. In a machine for sealing lids to containers having a body with upstanding sidewall portions and a flange portion extending laterally outwardly about the upper periphery thereof, the combination comprising:

a carousel including a revolving horizontal table with means at each of a multiplicity of lications spaced circumferentially thereabout for seating such a container and for providing underlying support for its flange portion, said table also having a mechanism thereon at each of said seating locations for sealing a lid upon a container thereat, under pressure in cooperation with said seating means and movable concurrently with said table as said table revolves;

an infeed system for delivering such containers sequentially to each of said locations as said table revolves, said system defining a feed channel and including at least one substantially horizontally disposed timing screw disposed at the base of said feed channel and dimensioned and configured to engage the body of such a container within the convolution of its thread portion for conveyance thereàlong from an intake end to an outlet end thereof, a guide element having a surface portion disposed laterally adjacent and upwardly of said screw and extending generally parallel to the axis thereof for abutment by the containers conveyed thereby, and means adjacent said intake end of said timing screw for supporting the containers in a horizontal attitude and for sequentially presenting them to the upper portion of said screw; and an elevator mechanism disposed below said table at each of said locations thereon, said elevator mechanism including a platform and elevator means for raising and lowering said platform between a position substantially flush with the top of said table and a position downwardly therefrom, said elevator means being actuatable to raise said platform when the one of said locations with which it is associated is adjacent the outlet of said infeed system, and to lower said platform as said table rotates to move said one location therebeyond, said carousel table including a pair of guide pins at each of said seating locations, said pins being disposed adjacent the circumferentially opposite ends of said container seating means and being mounted for vertical movement between positions extended above the upper surface of said table and positions substantially flush therewith, said pins being operatively connected to said elevator mechanism to move upwardly when said platform is lowered, and vice versa.

27. In a machine for sealing lids to containers having a body with upstanding sidewall portions and a flange portion extending laterally outwardly about the uppr periphery thereof, the combination comprising:

a carousel including a revolving horizontal table with means at each of a multiplicity of locations spaced circumferentially thereabout for seating such a container and for providing underlying support fon its flange portion, said table also having a mechanism thereon at each of said seating locations for sealing a lid upon a container thereat, under pressure in cooperation with said seating means and movable concurrently with said table as said table revolves said sealing mechanism at each of said table locations comprising an electrically heated sealing head mounted on said table for movement between a closed position directly over said seating means and an open position displaced therefrom, said sealing head being pivotably mounted for such movement by a toggle clamp arrangement, said sealing mechanism including a pneumatic piston for effecting such movement of said head, and means for actuating said piston to properly position said head with respect to said seating means in timed relationship to the revolution of said table; and an infeed system for delivering such containers sequentially to each of said locations as said table revolves, said system defining a feed channel and including at least one substantially horizontally disposed timing screw disposed at the base of said feed hannel and dimensioned and configured to engage the body of such a container within the convolution of its thread portion for conveyance therealong from an intake end to an outlet end thereof, a guide element having a surface portion disposed laterally adjacent and upwardly of said screw and extending generally parallel to the axis thereof for abutment by the containers conveyed thereby, and means adjacent said intake end of said timing screw for supporting the containers in a horizontal attituted and for sequentially presenting them to the upper portion of said screw.

28. In a machine for sealing lids to containers having a body with upstanding sidewall portions and a flange portion extending laterally outwardly about the upper periphery thereof, the combination comprising:

a carousel including a revolving horizontal table with means at each of a multiplicity of locations spaced circumferentially thereabout for seating such a container and for providing underlying support for its flange portion, said table also having a mechanism thereon at each of said seating locations for sealing a lid upon a container thereat, under pressure in cooperation with said seating means and movable concurrently with said table as said table revolves;

an infeed system for delivering such containers sequentially to each of said locations as said table revolves, said system defining a feed channel and including at least one substantially horizontally disposed timing screw disposed at the base of said feed channel and dimensioned and configured to engage the body of such a container within the convolution of its thread portion for conveyance therealong from an intake end to an outlet end thereof, a guide element having a surface portion disposed laterally adjacent and upwardly of said screw and extending generally parallel to the axis thereof for abutment by the containers conveyed thereby, and means adjacent said intake end of said timing screw for supporting the containers in a horizontal attitude and for sequentially presenting them to the upper portion of said screw; and an outfeed system for effecting the removal of lidded containers from said table as said table revolves, said system including a ramp having a portion disposed over said table to intercept said seating locations and having means thereon for carrying the containers away from said table, said carrying means comprising a pair of endless bands disposed on said ramp with a channel therebetween for passage of the body portions of the containers, each of said bands having an upper flight for contact under an opposite side element of the flange portion, and being made of a material adapted to frictionally engage the container flange portion.

* * * * *

UNITED STATES PATENT AND TRADEMARK OFFICE

CERTIFICATE OF CORRECTION

PATENT NO. : 4,691,500

DATED : September 8, 1987

INVENTOR(S) : Ronald V. Danforth and Medric H. Pleau

It is certified that error appears in the above-identified patent and that said Letters Patent is hereby corrected as shown below:

Column 13, line 15, "lications" should be "locations"

Column 14, line 1, "fon" should be "for"

Signed and Sealed this

Twenty-sixth Day of April, 1988

*Attest:*

DONALD J. QUIGG

*Attesting Officer*

*Commissioner of Patents and Trademarks*